US005169354A

United States Patent [19]

Norton et al.

[11] Patent Number: 5,169,354

[45] Date of Patent: Dec. 8, 1992

[54] SELF-RIGHTING TOY CAROUSEL

[75] Inventors: John J. Norton, East Aurora; Clayton D. Roberts, Colden, both of N.Y.

[73] Assignee: Fisher-Price, Inc., East Aurora, N.Y.

[21] Appl. No.: 706,792

[22] Filed: May 29, 1991

[51] Int. Cl.[5] ..... A63H 1/06; A63H 15/06

[52] U.S. Cl. ..... 446/241; 446/396; 446/418

[58] Field of Search ..... 446/241, 325, 326, 396, 446/273, 274, 265, 418, 236; 272/77

[56] References Cited

U.S. PATENT DOCUMENTS

| | | | |
|---|---|---|---|
| 901,762 | 10/1908 | Wetzel | 446/325 |
| 1,985,716 | 12/1934 | Bueschel | 446/241 |
| 2,018,537 | 10/1935 | Savage | 446/241 |
| 2,332,507 | 10/1943 | Dailey | 446/256 X |
| 2,504,652 | 4/1950 | Cohn | 446/325 X |
| 2,554,516 | 5/1951 | Anthony | 446/325 |
| 3,084,478 | 4/1963 | Burger | 446/241 |
| 3,785,081 | 1/1974 | Burkhart | 446/241 |
| 3,805,444 | 4/1974 | Adickes | 446/396 |
| 3,859,750 | 1/1975 | McKay | 446/325 |
| 3,898,762 | 8/1975 | Balleis | 446/241 |
| 3,921,331 | 11/1975 | Schatz | 446/325 |
| 3,983,659 | 10/1976 | Wasson | 446/241 |
| 4,129,963 | 12/1978 | Perry, Jr. et al. | 446/325 |
| 4,211,030 | 7/1980 | Morrison et al. | 446/236 |
| 4,355,481 | 10/1982 | Joslyn | 446/241 |
| 4,522,604 | 6/1985 | Stubbmann | 446/219 |
| 4,536,167 | 8/1985 | Hughes | 446/325 X |
| 4,643,692 | 2/1987 | Magers | 446/259 |

FOREIGN PATENT DOCUMENTS

| | | | |
|---|---|---|---|
| 485419 | 10/1929 | Fed. Rep. of Germany | 446/325 |

*Primary Examiner*—Mickey Yu
*Attorney, Agent, or Firm*—Cumpston & Shaw

[57] ABSTRACT

A self-righting carousel toy having an eccentrically mounted internal weight for inducing oscillation of the toy about an upright position upon rotation of the weight relative to the base. The toy includes a drive mechanism for selectively rotating a display assembly relative to the base, independent of the self-righting forces.

4 Claims, 4 Drawing Sheets

SELF-RIGHTING TOY CAROUSEL

The present invention relates to self-righting toys, more particularly to a self-righting toy having an independently rotatable, eccentrically mounted weight, which rotates to its lowest available position upon displacement of the toy from an upright position.

BACKGROUND OF THE INVENTION

Prior self-righting toys include U.S. Pat. No. 2,554,516, wherein a self-righting toy includes an inner display figure which oscillates upon a spring.

U.S. Pat. No. 4,522,604 discloses a rockable toy with a reflecting mirror, wherein the body of the toy oscillates about a stable position in which the center of gravity is situated above the point of contact of the toy and a support surface.

U.S. Pat. No. 4,355,481 discloses a mechanical carousel top having a base stand on which a turn table is rotatably mounted. The turn table is rotated relative to the base by a drive assembly including a driver and a unidirectional clutch assembly actuated by a reciprocating plunger.

SUMMARY OF THE INVENTION

The toy of the present invention includes a self-righting carousel having an independently rotatable eccentric weight.

The toy includes a base having a convex external surface for contacting a support surface and a weighted bottom to provide a self-righting force. A platform having a central aperture is attached to the base. A support shaft extends upwardly from the inner surface of the base through the aperture in the platform to terminate above the platform. Preferably, the shaft is independently rotatable relative to the platform and the base. A display assembly is affixed to the shaft as it extends above the platform so that the display assembly rotates with the shaft. A radially extending arm is affixed to the shaft below the platform. Preferably, a bell is affixed to the outer end of the arm to provide an eccentrically mounted weight on the shaft.

The carousel toy also includes a drive mechanism for selectively rotating the display assembly relative to the base. The display assembly may be rotated relative to the base by either of two methods.

In the first method, displacement of the base from the upright position causes the eccentric weight of the bell to rotate to the lowest available position relative to the support surface, thereby rotating the support shaft and the display assembly.

Alternatively, the drive mechanism may be selectively actuated to impart rotation to the display assembly. As the display assembly is rotated, the eccentric weight is rotated about the shaft. The rotation of the eccentric weight causes the base to oscillate, or wobble about the stable upright position. In addition, rotation of the weight causes the weight to contact strikers which ring the bell to produce musical tones.

DETAILED DESCRIPTION OF THE PREFERRED EMBODIMENT

Figure 1:
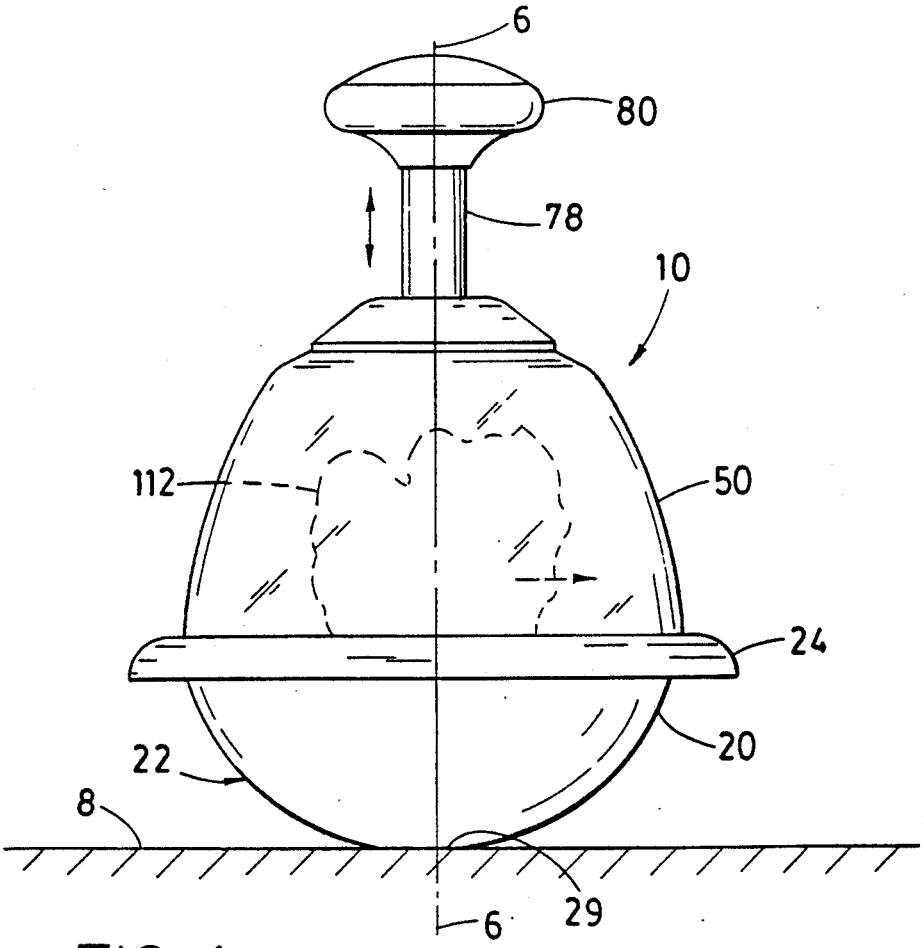
FIG. 1 is a side elevational view of the present invention.
Figure 3:
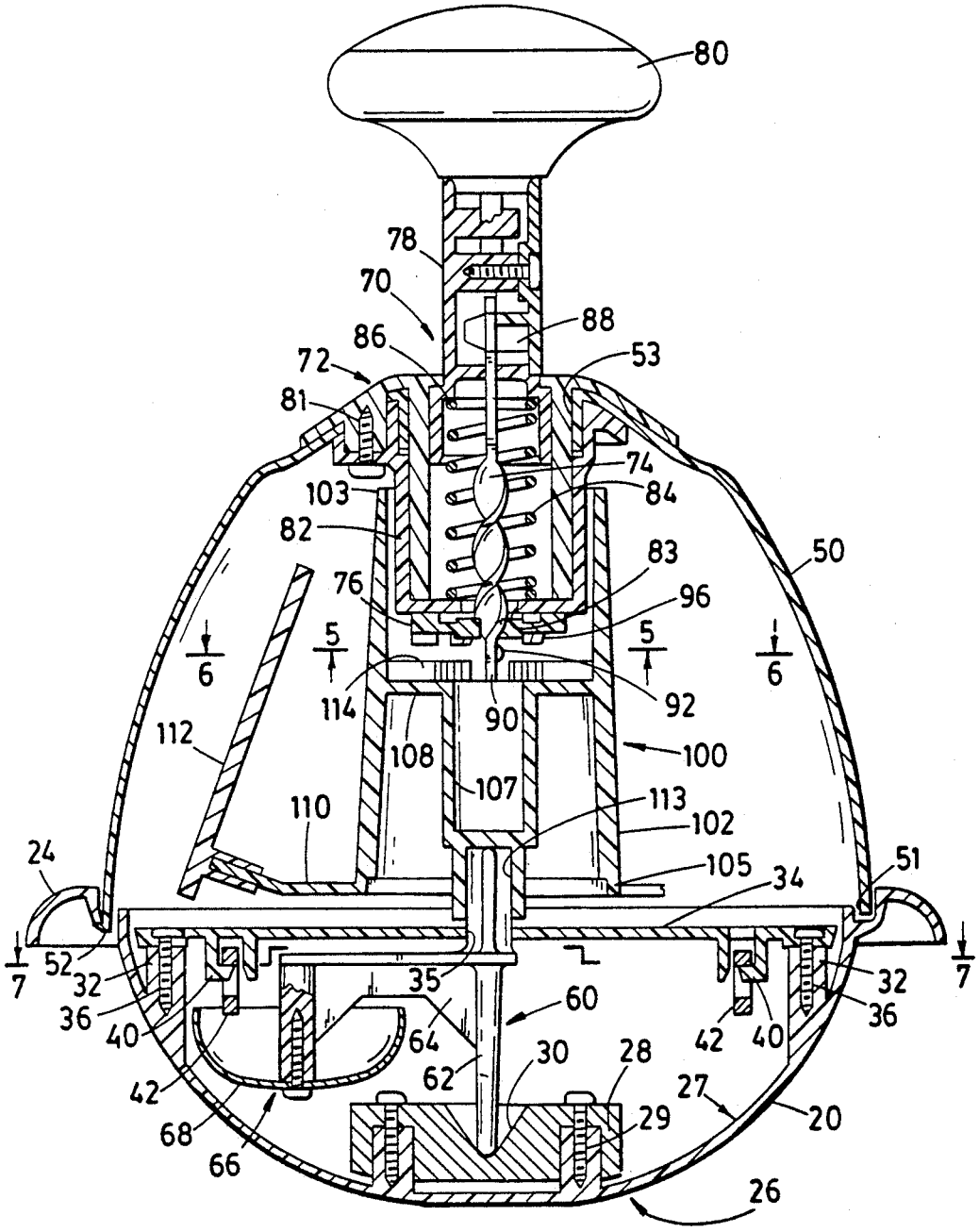
FIG. 3 is a cross-sectional view taken along lines 3—3 of FIG. 2.

Referring to FIGS. 1 and 3, the toy carousel 10 of the present invention includes a base 20, a transparent dome 50, a rotation assembly 60, a drive mechanism 70, and a display assembly 100.

Figure 2:
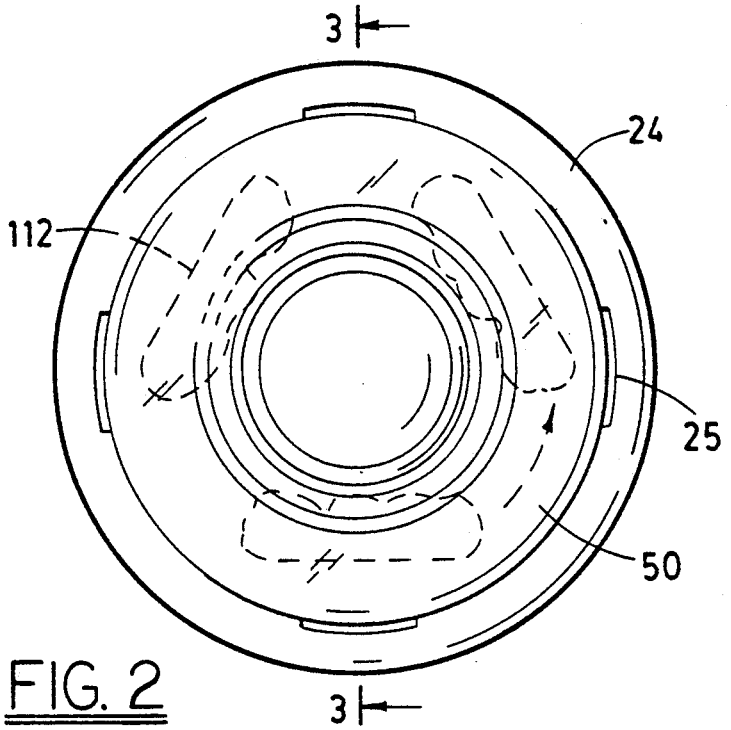
FIG. 2 is a top plan view of the carousel.

As shown in FIG. 1, the base 20 has a convex external surface 22 for contacting a support surface 8. The upper end of the base 20 terminates at an annular flange 24. Referring to FIG. 2, the flange 24 includes a plurality of spaced arcuate apertures 25. The internal surface of the base defines a substantially hemispherical cavity 27. The base 20 includes a stationary weight 28 attached to base 20 by suitable fasteners 29 (screws) and forms a weighted bottom 26 sufficient to self-right the base to a stable, upright position. In the upright position, as shown in FIG. 1, the base 20 is stable and defines a central axis 6 coincident with the vertical projection of the center of gravity of the base 20. In the stable position, the axis 6 extends vertically from the support surface 8 through the center of gravity of the base 20. As the base 20 oscillates, or wobbles about the stable position, the central axis 6 is correspondingly displaced from the vertical orientation. In the stable configuration, the center of gravity of the toy 10 is located vertically above the point of contact between the base 20 and the support surface 8. That is, the center of gravity of the toy 10 is located on the central axis and within the projection of the convex portion of the base when the toy is in the stable upright position, such that when the toy is displaced from the stable upright position in which the central axis is substantially vertical, the toy will oscillate about the upright stable position. The base includes a flattened portion 29 concentric with the central axis 6. The flattened portion 29 enhances the stability of the toy 10 in the stable upright position.

The function of the weighted bottom 26 may be achieved by constructing the bottom portion of the base 20 from a volume of sufficiently dense material (not shown) or concentrically affixing the stationary weight 28 to the internal surface of the bottom of the base. The stationary weight 28 includes a conical bearing surface 30 concentric with the base 20 and the central axis 6. The internal surface of the base 20 also includes inner bosses 32 defining a common plane between the bottom of the base and the flange 24. The base 20 may be formed from a thermoplastic materials such as styrene. A preferred material is high impact styrene.

Referring to FIG. 3, a circular platform 34 is disposed on the bosses 32 and may be secured to the base by means well known in the art, such as adhesives, fasteners, or screws 36. The platform 34 includes an aperture 35 concentric with the central axis 6. The underside of the platform includes a pair of depending brackets 40 disposed on a common diameter. A metallic striker 42 is secured in each bracket 40 such that the striker may be vertically displaced within the bracket.

As shown in FIGS. 1, 2 and 3, the dome 50 is secured to the base 20 at the flange 24 and is preferably a transparent plastic material, such as buterate. The dome 50 includes an open bottom 51, having a plurality of peripheral tabs 52. The tabs 52 are received within apertures 25 of the flange 24 and lock the dome 50 to the base 20. The upper end of the dome 50 includes a central aperture 53 concentric with the axis 6.

Figure 7:
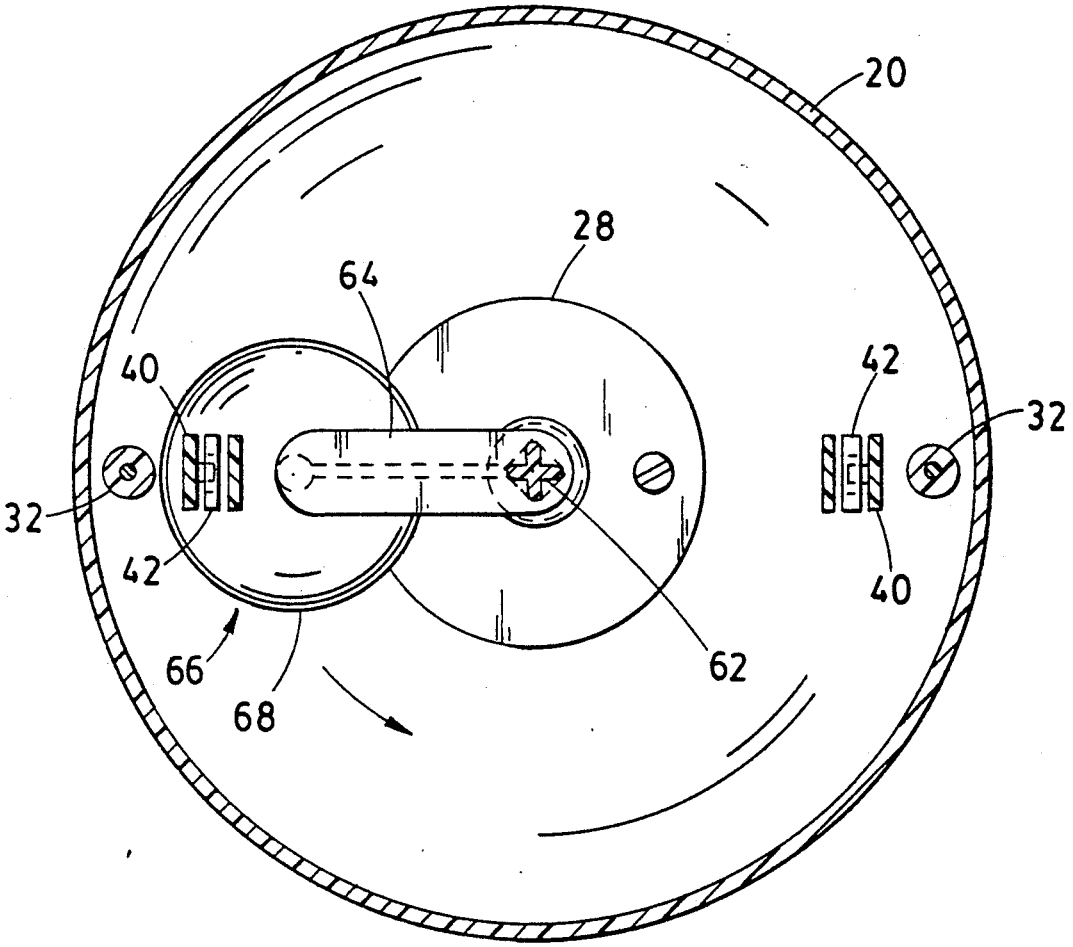
FIG. 7 is a cross-sectional view taken along lines 7—7 of FIG. 3.

Referring to FIGS. 3 and 7, the rotation assembly 60 includes a shaft 62, a mounting arm 64, and an eccentric weight 66. The bottom of the shaft 62 is disposed in the bearing surface 30 of the stationary weight 28 and is rotatable relative to the stationary weight and the base 20. The shaft 62 extends upwardly through the platform 34 to terminate above the platform. Therefore, the shaft 62 is concentric with the central axis 6.

As shown in FIGS. 3 and 7, the upper end of the shaft 62 is sized to cooperatively engage the display assembly 100. The upper end of the shaft 62 has an "X-shaped" cross section. Although the shaft 62 is shown as independently rotatable relative to the base 20, the shaft 62 may be fixed relative to the base 20, wherein the display assembly and eccentric weight rotate about the shaft.

The mounting arm 64 is affixed to the shaft 62 beneath the platform 34 and extends radially from the shaft. The eccentric weight 66 is affixed to the outer end of the arm 64. Preferably, the weight 66 is a bell 68, such that upon rotation of the bell about the central axis 6, the bell contacts the depending strikers 42. Although the weight of the bell 66 is employed as the eccentric weight, the eccentric weight 66 may be a dummy weight at the end of the arm 64. The arm 64 provides rotation of the weight 66 in a plane transverse to the central axis 6. Alternatively, the bell 68 may be omitted and the display assembly 100 may be eccentrically weighted.

The self-righting weighting of the base 20 to the upright position produces a sufficiently large righting force so that the relative stationary position of the eccentric weight 66 does not prevent the base from self-righting to a stable, substantially upright position wherein the flattened portion 29 contacts the support surface 8.

Referring to FIG. 3, the drive mechanism 70 is retained in the central aperture 53 of the dome 50, and includes a drive housing 72, a helical rod 74, a pawl 76, a plunger 78, and a knob 80. The drive housing 72 is affixed to the dome 50 and depends downward into the volume defined by the dome. The drive housing 72 is secured to the dome 50 by adhesives or fasteners 81 so that the drive housing does not move relative to the dome. The drive housing 72 includes a depending cup 82 having a concentric aperture 83 in the bottom. The plunger 78 is slidably received within the cup 82 and is biased upwardly by a compression spring 84. The compression spring 84 is disposed between the bottom of the cup 82 and the plunger 78. Upward motion of the plunger 78 relative to the drive housing 72 is limited by contact of shoulder 86 with the drive housing.

Figure 4:
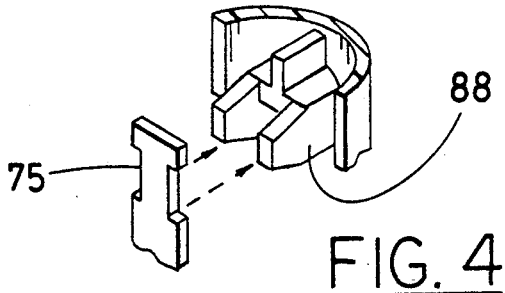
FIG. 4 is a partial perspective showing the engagement of the helical rod and the plunger.

As shown in FIGS. 3 and 4, the helical rod 74 is affixed to the plunger 78 and extends downward through the aperture 83 in the bottom of the cup 82. As shown in FIG. 4, the plunger 78 includes a yoke 88 sized to receive a constricted length 75 of the helical rod 74. Engagement of the helical rod 74 and the plunger 78 precludes rotation of the rod relative to the plunger 78.

Figure 5:
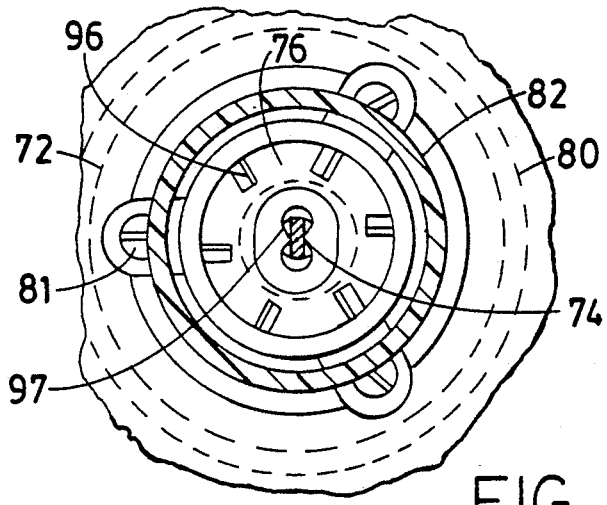
FIG. 5 is a cross-sectional view taken along lines 5—5 of FIG. 3.

Referring to FIG. 3, when the plunger 78 is in the full upward position, the helical rod 74 terminates at a terminal end 90 below the bottom of the drive housing 72. The pawl 76 is disposed on the length of helical rod 74 which depends below the drive housing 72. The terminal end 90 includes a retaining pin or bump 92 to prevent the pawl 76 from disengaging the rod 74. Referring to FIGS. 3 and 5, the pawl 76 includes a plurality of depending teeth 96 and a contact aperture 97. The contact aperture 97 causes the panel 76 to follow the helical length of the rod, so that as the helical rod passes longitudinally through the contact aperture, the pawl rotates relative to the rod 74. As shown in FIG. 5, the contact aperture 97 defines a figure eight periphery wherein the constricted portion of the periphery contacts the middle of the width of the helical rod 74. By providing a range of movement for the lateral edges of the helical rod 74 within the contact aperture 97, the pawl 76 smoothly tracks the helical rod, as discussed infra.

Referring to FIGS. 1–3, the display assembly 100 includes a central drum 102 having an upper end 103 and a lower end 105, a central recess 107 open to the upper end, a ratchet shoulder 108 within the central recess, a plurality of radial arms 110, a plurality of display FIGS. 112, and a coupler recess 113 open to the lower end. The display assembly 100 is concentrically aligned with the drive mechanism 70 and the central axis 6 as the coupler recess 113 receives the upper end of the support shaft 62. As shown in FIG. 7, the coupler recess 113 may have a square cross section sized to receive the X cross section of the shaft diagonally within the recess.

Figure 6:
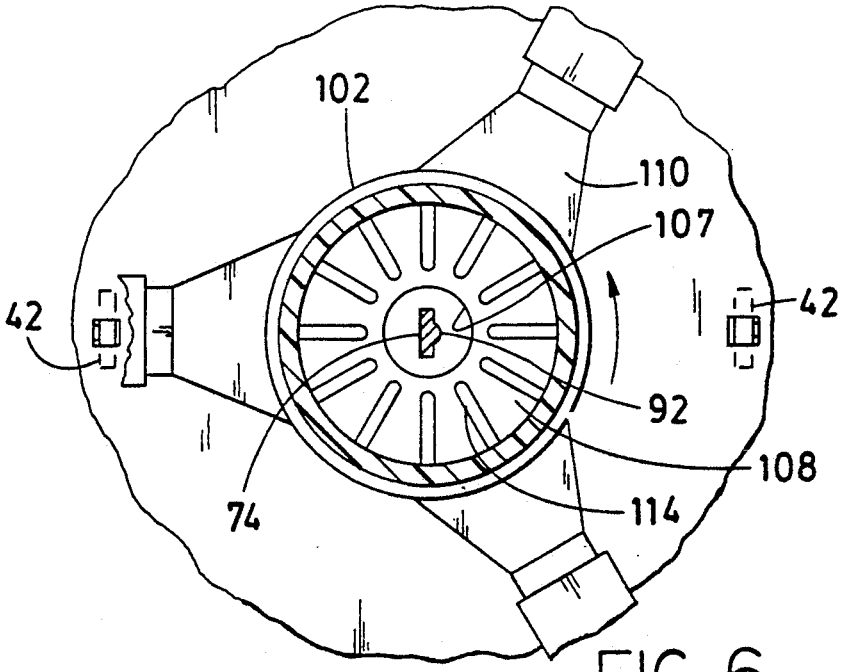
FIG. 6 is a cross-sectional view taken along lines 6—6 of FIG. 3.

Referring to FIG. 3, the central recess 107 has a sufficient depth such that upon full downward motion of the helical rod 74 relative to the drive housing 72, the helical rod does not contact the drum 102. As shown in FIGS. 3 and 6, the ratchet shoulder 108 extends radially inward from the periphery of the drum 102, and is concentric with the central axis 6. The shoulder 108 includes a plurality of upwardly extending radial teeth 114 sized to engage the pawl 76. The lower end 105 of the drum 102 is disposed proximal to the platform 34. The radial arms 110 extend from the lower end 105 and include the display FIGS. 112 at the terminal ends. When the bell 68 is employed as the eccentric weight 66, the display FIGS. 112 are concentrically disposed about the axis 6 (as shown in FIG. 2). If the eccentric weight 66 is not embodied in the display assembly 100, the FIGS. 112 may be unequally weighted or eccentrically mounted about the axis 6 (not shown).

As the drive mechanism 70 is normally biased out of operable engagement with the display assembly 100, the shaft 62, the eccentric weight 66 and the display assembly 100 can rotate freely with respect to the base 20 and the dome 50.

OPERATION OF THE TOY

The display assembly 100 is freely rotatable with the shaft 62 and may be rotated by either of two methods. The first method rotates the display assembly 100 due to reorientation of the eccentric weight 66 relative to the base 20. The second method employs the drive mechanism 70 to rotate the display assembly 100.

In the first method, rotation of the eccentric weight 66 relative to the base 20 is accomplished by displacing the base from the stable upright position. As the base 20 is displaced from the upright, stable position, the eccentric weight 66 rotates about the central axis 6 to occupy the lowest available position in the orbit about the central axis. The eccentric weight 66 rotates to the lowest available position relative to the contact surface to minimize its potential energy. As the eccentric weight 66 rotates, the shaft 62 rotates, thereby rotating the display assembly 100. Therefore, rocking the base 20 about the stable upright position causes the eccentric weight 66 to rotate the shaft 62 and display assembly 100 as the weight seeks the lowest available elevation relative to the support surface 8.

Alternatively, the drive mechanism 70 may be used to selectively rotate the display assembly 100. The rotation of the display assembly 100 is achieved by a vertical reciprocating motion of the knob 80 and plunger 78. When the knob 80 and plunger 78 are depressed, the helical rod 74 is urged downward against the bias of the compression spring 84. As the helical rod 74 is displaced downwardly in the central recess 107, the pawl 76 is driven downward to operably engage the ratchet shoulder 108. Further downward displacement of the helical rod 74 causes the helical portion to engage the contact aperture 97, thereby inducing rotation of the pawl. The rotation of the pawl 76 is transmitted to the drum 102, thereby rotating the display FIGS. 112.

Upon termination of the downward force upon the knob 80, the upward bias of the spring 84 urges the plunger 78 upward, which draws the helical rod 74 upward. The upward motion of the helical rod 74 disengages the pawl 76 from the ratchet shoulder 108. Upon disengagement of the pawl 76 the display assembly 100 continues to rotate freely until frictional forces terminate rotation.

When the display assembly 100 is rotated by either method, the bell 68 or eccentric weight cause the base 20 to wobble, or oscillate about the stable upright position. In addition, the rotating bell 68 contacts the depending strikers 42, which ring the bell to produce pleasing musical tones.

While a preferred embodiment of the invention has been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

What is claimed is:

1. A toy, comprising:

(a) a self-righting base having a convex external supporting surface for contacting a support surface, wherein the base is self-righting to an upright position defining a central axis which includes the vertical projection of the center gravity of the base;

(b) an eccentrically mounted bell rotatable relative to the base such that upon displacement of the base from the upright position, the bell rotates about the central axis, wherein the bell has a sufficient mass to cause the toy to wobble about the central axis upon rotation of the bell relative to the base; and (c) a striker connected to the base for contacting the bell upon rotation of the bell about the central axis.

2. A toy comprising:

(a) a self-righting base;

(b) a display assembly rotatable relative to the base about a central axis;

(c) a reciprocating plunger releasably connected to the display assembly, the plunger movable between a first and a second position along the central axis; and (d) an eccentric weight connected to the display assembly for rotation with the display assembly such that upon rotation of the display assembly the eccentric weight causes the toy to wobble about the central axis.

3. A toy, comprising:

(a) a self-righting base having a convex external supporting surface for contacting a support surface, wherein the base is self-righting to an upright position defining a central axis which includes the vertical projection of the center gravity of the base;

(b) an eccentrically mounted weight rotatable relative to the base such that upon displacement of the base from the upright position, the weight rotates about the central axis, wherein the weight has a sufficient mass to cause the toy to wobble about the central axis upon rotation of the weight relative to the base; and (c) reciprocating means for rotating the weight about the central axis.

4. A toy, comprising:

(a) a base having a convex external surface for contacting a support surface, and a weight for producing a self-righting force sufficient to dispose the base in an upright position;

(b) a shaft concentrically aligned with the base and rotatable relative to the base;

(c) an eccentric weight connected to the shaft for rotation with the shaft;

(d) a display assembly connected to the shaft for rotation with the shaft;

(e) a transparent dome affixed to the base to enclose the display assembly between the base and the dome; and (f) drive means for selectively rotating the display assembly relative to the base, wherein the drive means includes a ratchet shoulder in the display assembly; a helical rod reciprocally disposable relative to the display assembly; and a pawl disposed on the helical rod for following the helical rod such that upon longitudinal displacement of the pawl relative to the helical rod, the pawl releasably engates the ratchet shoulder to rotate the display assembly relative to the base.

* * * * *